US006088547A

United States Patent [19]

Martin et al.

[11] Patent Number: 6,088,547

[45] Date of Patent: Jul. 11, 2000

[54] AUTOMATIC FUSER TEMPERATURE CONTROL

[75] Inventors: Michael J. Martin, Boise; Nancy Cernusak, Eagle; John W. Huffman, Meridian, all of Id.

[73] Assignee: Hewlett-Packard Company, Palo Alto, Calif.

[21] Appl. No.: 09/354,638

[22] Filed: Jul. 16, 1999

[51] Int. Cl.[7] ..... G03L 15/20

[52] U.S. Cl. ..... 399/45; 399/69

[58] Field of Search ..... 399/45, 67, 69; 73/587

[56] References Cited

U.S. PATENT DOCUMENTS

| | | | |
|---|---|---|---|
| 4,897,670 | 1/1990 | Hasegawa et al. | 347/193 |
| 5,014,547 | 5/1991 | Holroyd | 73/105 |
| 5,689,757 | 11/1997 | Ferrante et al. | 399/45 |

FOREIGN PATENT DOCUMENTS

| | | |
|---|---|---|
| 4-121770 | 4/1992 | Japan . |
| 4-316078 | 11/1992 | Japan . |
| 5-333746 | 12/1993 | Japan . |
| 7-209928 | 8/1995 | Japan . |

*Primary Examiner*—Joan Pendegrass

[57] ABSTRACT

As print media advances through a paper path of an electrophotographic printer, the print media vibrates and a sympathetic response is induced in elements in contact with the print media. Rough print media vibrates more than smooth print media does. The sympathetic response induced by the print media advancing through the paper path is measured. A fuser temperature is selected using the measured sympathetic response. A higher fuser temperature is selected for print media inducing a larger sympathetic response and a lower fuser temperature is selected for print media inducing a smaller sympathetic response.

12 Claims, 2 Drawing Sheets

AUTOMATIC FUSER TEMPERATURE CONTROL

FIELD OF THE INVENTION

This invention relates in general to electrophotographic image forming systems such as laser printers and, more particularly, to fuser temperature control in electrophotographic printers.

BACKGROUND OF THE INVENTION

Conventional electrophotographic or laser printers operate by using a roller or a series of rollers to pull a print media (typically a sheet of paper) from a paper tray, and to push the media to a registration roller assembly. The registration roller assembly aligns the media so that the edges of the media are parallel to the media path.

Once the media is properly aligned, the registration roller assembly passes the media to a photoconductor surface, such as a drum or belt. The photoconductor surface has a latent image on its surface formed by scanning a laser across the photoconductor surface. A difference in electrostatic charge density is created between the areas on the surface exposed and unexposed to the laser beam. A visible image is developed by toners that are selectively attracted to the photoconductor surface, either exposed or unexposed to light, depending on the relative electrostatic charges of the photoconductor surface, development electrode, and the toner. The photoconductor may be either positively or negatively charged, and the toner similarly may contain negatively or positively charged particles.

The media is given an electrostatic charge and passed close to the photoconductor surface. As the media passes close to the photoconductor surface, it pulls the toner from the photoconductor surface onto the media still in the pattern of the image developed from the photoconductor surface.

After receiving the image, the media is passed to a fuser. The fuser heats the toner image on the media, bonding the toner to the media.

The temperature of the fuser is critical. Rough media requires a higher fuser temperature than smooth media. If the temperature is too low, toner will not be adequately fused to the media. If the temperature is too high, the toner will be pulled from the media by the fuser. Either case results in an undesirable print defect. Additionally if the fuser temperature is too high, the media may curl or wrinkle.

Many laser printers have a fixed fuser temperature. The fixed fuser temperature is optimized for typical media types. Fixed fuser temperatures cannot accommodate media types that require more heat to properly fuse the toner to the media. Additionally, media types requiring lower fuser temperatures may be damaged by the heat of the fixed fuser temperatures.

In order to provide a laser printer that better accommodates a wide variety of print media, lasers printers have been developed that allow a user to control the fuser temperature by indicating to the printer which media type will be used. The fuser controller adjusts the fuser temperature according to the type of media. This type of fuser temperature control depends on the user to accurately indicate the media type. Additionally, when media type is changed, printing must be stopped to allow the user to indicate the new media type.

SUMMARY OF THE INVENTION

According to principles of the present invention, as print media advances through a paper path of an electrophotographic printer, the print media vibrates. The vibrating print media induces a sympathetic response in elements in contact with the print media. Rough print media vibrates more than smooth print media does. The sympathetic response induced by the print media advancing through the paper path is measured. A fuser temperature is selected using the measured sympathetic response. A higher fuser temperature is selected for print media inducing a larger sympathetic response and a lower fuser temperature is selected for print media inducing a smaller sympathetic response.

According to further principles of the present invention, the vibrations are enhanced by positioning a rubbing surface so that the print media passes over the rubbing surface as the print media advances through the paper path. Positioning rubbing surfaces so that each surface of the print media passes over at least one rubbing surface allows a measurement of sympathetic responses induced by each surface of the print media.

Other objects, advantages, and capabilities of the present invention will become more apparent as the description proceeds.

DETAILED DESCRIPTION OF THE INVENTION

Figure 1:
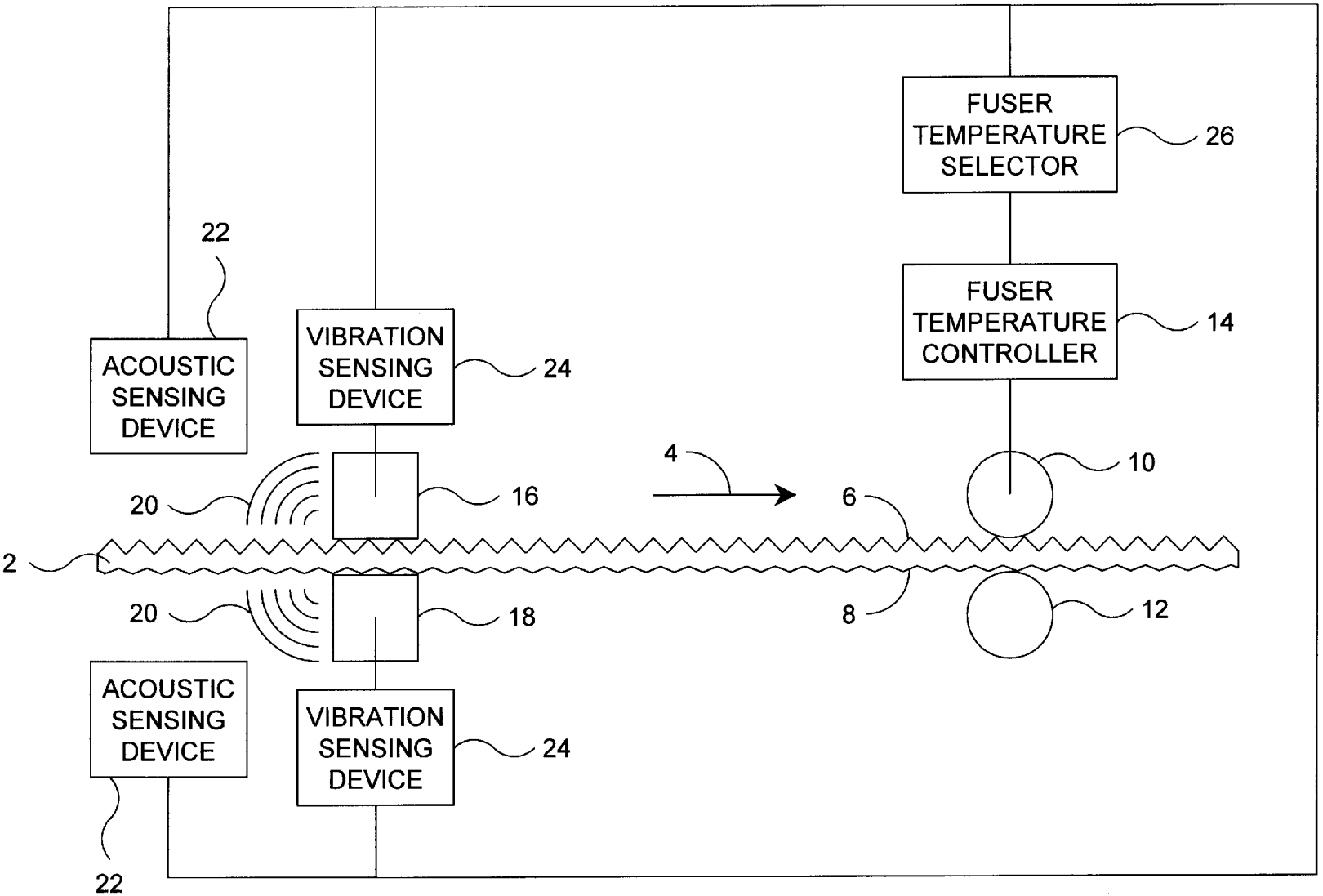
FIG. 1 is a block diagram illustrating a system of the present invention.

Referring to FIG. 1, a system is shown for selecting a fuser temperature in an electrophotographic printer. Print media 2 travels in direction 4 on a paper path through an electrophotographic printer such as a laser printer. Print media 2 is typically a sheet of paper, but may be any media on which the electrophotographic printer will print. Print media 2 includes two surfaces 6, 8. Surfaces 6, 8 are either equally rough or one surface 6 is rougher than the other surface 8. Surfaces 6, 8 are not drawn to scale. The roughness of surfaces 6, 8 is exaggerated for illustrative purposes. FIG. 1 depicts rougher surface 6 as the surface to receive a printed image. Alternatively, smoother surface 8 may receive the printed image.

The paper path is the path that print media 2 follows as it advances through the electrophotographic printer. The paper path passes between fuser 10 and pressure roller 12. The temperature of fuser 10 is controlled by fuser temperature controller 14.

Mechanisms 16, 18 are positioned adjacent the paper path to contact a surface 6, 8 of print media 2 as print media 2 advances through the paper path. Mechanisms 16, 18 are any mechanisms that contact print media 2 as print media 2 advances along the paper path. For example, mechanisms 16, 18 may include rollers, shafts, guides, switches, sensors, or rubbing surfaces, such as rubbing ribs or rubbing blocks.

Mechanisms 16, 18 may be positioned opposite other mechanisms 16, 18 as depicted in FIG. 1. Alternatively, mechanisms 16, 18 are positioned so that they are not opposite another mechanism 16, 18. Additionally, although FIG. 1 depicts a mechanism adjacent each surface 6, 8 of print media 2, only one mechanism 16 or 18 must be present. More than two mechanisms 16, 18 may also be present.

As print media 2 advances along the paper path adjacent a mechanism 16, 18, print media 2 vibrates. Rough print media 2 vibrates more than smooth print media 2 does. The vibration from print media 2 induces a sympathetic response in elements in contact with print media 2. Rough surface 6 induces a larger sympathetic response than smooth surface 8 does. Elements in contact with print media 2 include air and mechanisms 16, 18.

The sympathetic response is a response by the elements in contact with print media 2 that results from the vibrations of print media 2. For examples, when print media 2 vibrates, sound waves 20 are generated and propagate through the air. Also, mechanisms 16, 18 vibrate in response to the vibrations of print media 2. Sound waves 20 and vibrations of mechanisms 16, 18 are sympathetic responses induced by the vibrations of print media 2.

Alternatively, as print media 2 advances along the paper path adjacent a mechanism 16, 18, mechanism 16, 18 vibrates. Rough print media 2 causes mechanism 16, 18 to vibrate more than smooth print media 2 does. Also, rough surface 6 causes mechanism 16, 18 to vibrate more than smooth surface 8 does. The vibration of mechanism 16, 18 is a sympathetic response to the roughness of print media 2. Also, sound waves 20 generated by the vibration of mechanism 16, 18 are a sympathetic response induced in an element (air) in contact with print media 2.

Acoustic sensing devices 22 are devices for sensing sound waves 20 induced in the air as print media 2 is advanced along the paper path. Acoustic sensing devices 22 are any devices, such as microphones, for sensing sound. Acoustic sensing devices 22 may also measure an amplitude of sound waves 20. Alternatively, acoustic sensing devices 22 may provide acoustic information to fuser temperature controller 14 or fuser temperature selector 26.

Acoustic sensing device 22 may be positioned anywhere relative to print media 2 and mechanism 16, 18. However, acoustic sensing devices 22 mounted close to the source of sound waves 20 will detect sound waves 20 better than acoustic sensing devices 22 mounted farther from the source of sound waves 20.

Vibration sensing devices 24 senses vibrations of mechanisms 16, 18. Vibration sensing devices 24 are any devices, such as accelerometers for sensing vibration. Vibration sensing devices 24 may also measure an amplitude of the vibrations of mechanisms 16, 18. Alternatively, vibration sensing devices 24 may provide vibration information to fuser temperature controller 14 or fuser temperature selector 26.

Although FIG. 1 includes two acoustic sensing devices 22 and two vibration sensing devices 24, only one acoustic sensing device 22 or one vibration sensing device 24 need be present. Acoustic sensing devices 22 and vibration sensing devices 24 provide feedback to fuser temperature controller 14.

Alternatively, acoustic sensing devices 22 and vibration sensing devices 24 provide feedback to a fuser temperature selector 26. Fuser temperature selector 26 selects the fuser temperature using input from one or more acoustic sensing devices 22, one or more vibration sensing devices 24, or a combination of one or more acoustic sensing devices 22 and one or more vibration sensing devices 24. Fuser temperature selector 26 then provides the selected temperature to fuser temperature controller 14.

Figure 2:
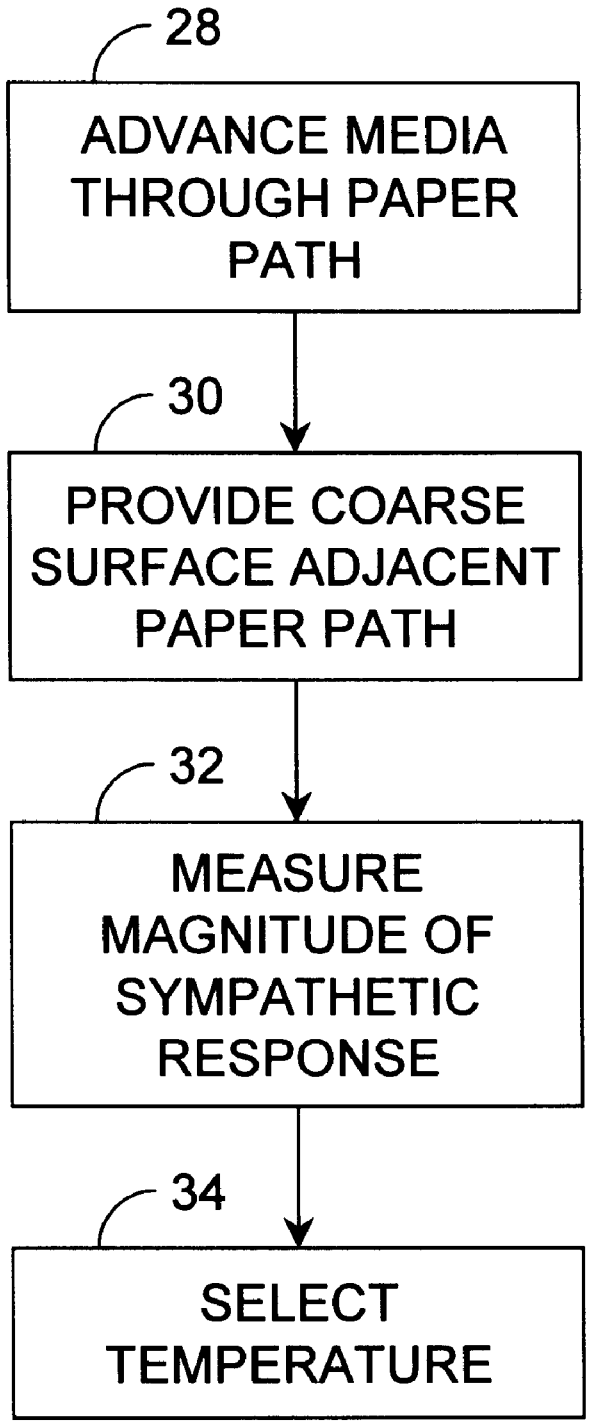
FIG. 2 is a flow chart illustrating one embodiment of a method of the present invention.

Referring now to FIG. 2, one embodiment of a method of the present invention is depicted. Print media 2 is advanced 28 along the paper path. Optionally, a rubbing surface is provided 30 adjacent the paper path positioned to contact at least one surface 6, 8 of print media 2 as print media 2 advances through the paper path.

A sympathetic response is induced in elements in contact with print media 2 as print media 2 advances through the paper path. The sympathetic response is induced by the roughness of print media 2 as it passes mechanism 16, 18. The magnitude of the sympathetic response is measured 32. Either acoustic sensing device 22 or vibration sensing device 24 senses the sympathetic response. Measurement 32 of the sympathetic response may occur at acoustic sensing device 22, vibration sensing device 24, fuser temperature controller 14, or fuser temperature selector 26.

The measured magnitude of the sympathetic response is used to select 34 a fuser temperature. In one embodiment, the fuser temperature is a function of the measured magnitude. In an alternate embodiment, a lookup table is used to select 34 the fuser temperature. The lookup table and logic circuit required to use the lookup table may be located in one of the sensing devices 22, 24, the fuser temperature controller 14, or fuser temperature selector 26.

In the lookup table embodiment, the measured magnitude is matched to a magnitude value in the lookup table. Each of the magnitude values in the lookup table has a corresponding fuser temperature value. A fuser temperature value is identified from the lookup table as the fuser temperature value corresponding to the matched magnitude value. The identified fuser temperature value is the selected fuser temperature.

It should be understood that the foregoing description is only illustrative of the invention. Various alternatives and modifications can be devised by those skilled in the art without departing from the invention. Accordingly, the present invention is intended to embrace all such alternatives, modifications and variances that fall within the scope of the appended claims.

What is claimed is:

1. A method for selecting a fuser temperature in an electrophotographic printer, the method comprising:

(a) advancing a print media through a paper path of the electrophotographic printer;

(b) measuring a magnitude of sound induced in air by the print media as the print media passes through the paper path; and, (c) selecting the fuser temperature in response to the magnitude.

2. The method of claim 1 further including providing a rubbing surface adjacent the paper path positioned to contact at least one surface of the print media as the print media advances through the paper path, the rubbing surface causes the print media to produce sound as the print media advances across the rubbing surface.

3. The method of claim 1 wherein selecting the fuser temperature in response to the magnitude includes selecting the fuser temperature as a function of the magnitude.

4. The method of claim 1 wherein selecting the fuser temperature in response to the magnitude includes:

(a) matching the magnitude to a magnitude value in a lookup table; and, (b) identifying a fuser temperature value from the lookup table corresponding to the matched magnitude value; and, (c) selecting the identified fuser temperature value as the fuser temperature.

5. A system for selecting a fuser temperature in an electrophotographic printer, the system comprising:

(a) means for advancing a print media through a paper path of the electrophotographic printer;

(b) means for measuring a magnitude of sound induced in air by the print media as the print media passes through the paper path; and, (c) means for selecting the fuser temperature responsive to a measured magnitude.

6. The system of claim 5 further including a rubbing surface adjacent the paper path positioned to contact at least one surface of the print media as the print media advances through the paper path, wherein the rubbing surface the print media to produce sound as the print media advances across the rubbing surface.

7. The method of claim 5 wherein the means for selecting the fuser temperature in response to the magnitude includes means for selecting the fuser temperature as a function of the magnitude.

8. The method of claim 5 wherein the means for selecting the fuser temperature in response to the magnitude includes:

(a) a lookup table;

(b) means for matching the magnitude to a magnitude value in the lookup table;

(c) means for identifying a fuser temperature value from the lookup table corresponding to the matched magnitude value; and, (d) means for selecting the identified fuser temperature value as the fuser temperature.

9. A method for selecting a fuser temperature in an electrophotographic printer, the method comprising:

(a) advancing a print media through a paper path of the electrophotographic printer;

(b) measuring sound produced by the media advancing through the paper path; and, (c) selecting the fuser temperature in response to the measured sound.

10. The method of claim 9 further including providing a rubbing surface adjacent the paper path positioned to contact at least one surface of the print media as the print media advances through the paper path, the rubbing surface causes the print media to produce sound as the print media advances across the rubbing surface.

11. The method of claim 9 wherein selecting the fuser temperature in response to the measured sound includes selecting the fuser temperature as a function of the measured sound.

12. The method of claim 9 wherein selecting the fuser temperature in response to the measured sound includes:

(a) matching a magnitude of the measured sound to a magnitude value in a lookup table; and, (b) identifying a fuser temperature value from the lookup table corresponding to the matched magnitude value; and, (c) selecting the identified fuser temperature value as the fuser temperature.

* * * * *